US011577422B2

(12) United States Patent
Enriquez et al.

(10) Patent No.: US 11,577,422 B2
(45) Date of Patent: Feb. 14, 2023

(54) DISPLAY OR STORAGE ASSEMBLY FOR HANDHELD POWER TOOL

(71) Applicant: Husqvarna AB, Huskvarna (SE)

(72) Inventors: Ruben Enriquez, Concord, NC (US); Paul Warfel, Davidson, NC (US); Kofi Addai, Concord, NC (US); Michelle Sordi, Charlotte, NC (US); Bart Goodell, Skaneateles, NY (US); David Jonathan Hine, Skaneateles, NY (US); David A. Furth, Skaneateles, NY (US)

(73) Assignee: HUSQVARNA AB, Huskvarna (SE)

( * ) Notice: Subject to any disclaimer, the term of this patent is extended or adjusted under 35 U.S.C. 154(b) by 222 days.

(21) Appl. No.: 16/778,460

(22) Filed: Jan. 31, 2020

(65) Prior Publication Data

US 2021/0237304 A1 Aug. 5, 2021

(51) Int. Cl.
*B27B 17/00* (2006.01)
*A47F 7/00* (2006.01)
(Continued)

(52) U.S. Cl.
CPC ..... *B27B 17/0008* (2013.01); *A47F 7/0021* (2013.01); *B25H 3/006* (2013.01); *B27G 19/003* (2013.01)

(58) Field of Classification Search
CPC ..... B27B 17/00; B27B 17/02; B27B 17/0008; B25H 3/00; B25H 3/006; B25H 3/003;
(Continued)

(56) References Cited

U.S. PATENT DOCUMENTS 3,042,087 A * 7/1962 Otoupalik ..... B23Q 13/00 30/151
3,053,424 A * 9/1962 Reinhard ..... B25H 3/006 294/158
(Continued)

FOREIGN PATENT DOCUMENTS

CA 2570950 A1 6/2008
CN 207564624 U 7/2018
(Continued)

OTHER PUBLICATIONS

"Discover ideas about Landscaping Equipment," displaying products in a more accessible way. Stihl locking chain saw shelves Design of the Times 2012 Contest Declaration, last accessed Nov. 8, 2019, Retrieved from: https://www.pinterest.com/pin/21814379418772649/, all enclosed pages cited.
(Continued)

*Primary Examiner* — Sean M Michalski
*Assistant Examiner* — Richard D Crosby, Jr.
(74) *Attorney, Agent, or Firm* — Burr & Forman LLP

(57) ABSTRACT

A hanger for suspending a chainsaw in a display is provided. The display may include a bar assembly that includes two parallel bars that project substantially parallel to each other. The hanger may include a first interface portion disposed at a first end of the body, and the first interface portion may include a first aperture and a second aperture. The hanger may additionally include a second interface portion disposed proximate to a second end, and a portion of the first face of the body may extend along a guide bar of the chainsaw. The second interface portion may align with a receiving orifice formed in the guide bar to enable a releasable fastener to operably couple the guide bar to the hanger. The first and second apertures may be configured to slidingly engage with
(Continued)

the bars of the bar assembly to suspend the chainsaw from the bar assembly.

16 Claims, 9 Drawing Sheets

(51) Int. Cl.
*B25H 3/00* (2006.01)
*B27G 19/00* (2006.01)

(58) Field of Classification Search
CPC ..... B27G 19/003; B65D 73/0064; B65D 73/0071; B65D 73/0035
See application file for complete search history.

(56) References Cited

U.S. PATENT DOCUMENTS 3,292,671 A * 12/1966 Stromberg ..... B23Q 13/00 83/860
3,326,250 A * 6/1967 Kephart, Jr. ..... B23Q 13/00 30/151
3,344,818 A * 10/1967 Musgrove ..... B23Q 13/00 83/814
3,540,500 A * 11/1970 Greene ..... B27B 17/0008 83/821
3,806,010 A * 4/1974 Utigard ..... F41A 23/26 224/421
3,991,470 A * 11/1976 Cartmill ..... B27G 19/003 30/382
4,063,358 A * 12/1977 Hodge ..... B27G 19/003 30/371
4,109,900 A * 8/1978 Vandecoevering ..... B25B 5/10 269/102
4,369,575 A * 1/1983 Schurman ..... B25H 3/006 206/349
4,447,953 A * 5/1984 Lombardino ..... B27G 19/003 30/382
4,473,176 A * 9/1984 Harper ..... B25H 3/006 206/349
4,597,178 A * 7/1986 Dolata ..... B23D 63/168 30/138
4,621,426 A * 11/1986 Shivers ..... B27G 19/003 30/382
4,709,838 A * 12/1987 Campbell ..... A47G 25/18 211/115
4,784,263 A * 11/1988 Stanley ..... B65D 85/02 206/349
4,846,385 A * 7/1989 Fratus ..... B23Q 13/00 224/569
4,907,778 A * 3/1990 Rockwell ..... B23D 63/003 24/327
4,951,398 A * 8/1990 Bennett ..... B23Q 16/001 30/383
5,119,937 A * 6/1992 Reynolds, Jr. ..... B27B 17/0008 206/349
5,144,345 A * 9/1992 Nyman ..... B65D 73/0064 211/59.1
5,156,156 A * 10/1992 Ruzich ..... B27B 17/0083 30/382
5,435,065 A * 7/1995 Raczykowski ..... B27B 17/0083 30/382
5,669,145 A * 9/1997 Skripsky ..... B27B 17/0083 30/371
5,706,941 A * 1/1998 Erisoty ..... B26B 29/00 206/349
5,779,198 A * 7/1998 Rutherford ..... F16L 3/18 248/58
5,979,649 A * 11/1999 Rosler ..... B65D 25/10 206/349
6,038,775 A * 3/2000 Holladay ..... B23Q 9/0028 30/376
6,293,448 B1 * 9/2001 Pietrusynski ..... B26B 29/025 224/232
6,299,039 B1 * 10/2001 Hsu ..... A47F 5/0006 223/85
6,389,700 B2 * 5/2002 Paquin ..... B27B 17/02 30/382
6,883,664 B2 * 4/2005 Lee ..... B65D 85/20 206/349
6,901,668 B2 * 6/2005 Elsener-Zehnder ..... B26B 29/025 206/460
6,926,143 B1 * 8/2005 Chen ..... B25H 3/003 206/349
7,055,689 B2 * 6/2006 Chen ..... B25H 3/04 206/349
7,210,663 B2 * 5/2007 Wheeler ..... B65D 73/0064 206/349
7,650,992 B1 1/2010 Huang
7,861,997 B2 * 1/2011 Brewer, III ..... B63B 17/0081 248/680
8,087,520 B2 * 1/2012 Milella, Jr. ..... A47F 7/163 211/45
8,186,512 B2 * 5/2012 Bertken ..... B65D 73/005 206/488
8,443,972 B1 * 5/2013 Pendergraph ..... B65D 85/00 206/349
8,517,067 B2 * 8/2013 Barnhill ..... B25H 1/04 144/286.5
8,813,374 B2 * 8/2014 Lank ..... B23Q 13/00 30/381
8,839,998 B1 * 9/2014 Robinson ..... B60R 11/06 224/403
D737,573 S * 9/2015 Yanuszka ..... D3/274
9,192,997 B2 * 11/2015 Seigneur ..... B23D 63/168
9,249,003 B2 * 2/2016 Reeves ..... B25H 3/00
9,265,361 B1 * 2/2016 Streich ..... B65D 75/56
D757,454 S * 5/2016 Alesi ..... D6/315
9,789,627 B2 * 10/2017 Engelfried ..... B27G 19/003
D808,743 S * 1/2018 Barber ..... D7/646
10,052,752 B2 * 8/2018 Breeden, III ..... A47L 13/46
10,160,126 B2 * 12/2018 Ranieri ..... B26B 29/025
10,758,064 B2 * 9/2020 Carr ..... A47F 5/0006
D909,697 S * 2/2021 Jung ..... D32/46
11,160,406 B2 * 11/2021 Strassburger ..... A47G 25/005
2002/0125157 A1 * 9/2002 Hochstetler ..... B23Q 13/00 206/349
2003/0029748 A1 * 2/2003 Hargrave-Thomas ..... B25H 3/006 206/349
2005/0011075 A1 * 1/2005 Stones ..... B27B 17/0008 30/123
2006/0249549 A1 * 11/2006 Giampavolo ..... A47G 25/1457 223/85
2007/0289147 A1 * 12/2007 Irwin ..... B27B 17/0008 30/381
2008/0053930 A1 * 3/2008 Rohde ..... B27B 17/00 211/70.6
2008/0164400 A1 * 7/2008 Beechinor ..... B27B 17/0008 248/500
2008/0196257 A1 * 8/2008 Eller ..... B27B 17/0008 30/514
2009/0026105 A1 * 1/2009 Wu ..... B65D 73/0064 206/349
2009/0265943 A1 * 10/2009 Miller ..... B23D 53/12 30/380
2011/0068067 A1 * 3/2011 Foltz ..... A47F 5/0006 211/59.2
2011/0146086 A1 * 6/2011 Palmer ..... B27G 19/003 30/382
2011/0155612 A1 * 6/2011 Fowler ..... B65D 71/46 206/503
2011/0167649 A1 * 7/2011 Reed ..... B27B 17/00 30/371
2013/0020217 A1 * 1/2013 Alexander ..... B65D 73/0071 206/349

(56) References Cited

U.S. PATENT DOCUMENTS

| | | | | |
|---|---|---|---|---|
| 2013/0062240 | A1* | 3/2013 | Trontel | B65D 73/0064 206/459.5 |
| 2013/0146725 | A1* | 6/2013 | Noble | A47F 5/0006 248/220.21 |
| 2013/0340259 | A1* | 12/2013 | Huang | A47F 5/0006 30/123 |
| 2014/0246556 | A1* | 9/2014 | Stewart, III | B25H 3/00 248/506 |
| 2015/0083620 | A1* | 3/2015 | McGarry | B27B 17/0008 206/349 |
| 2015/0209956 | A1 | 7/2015 | Hu | |
| 2016/0023840 | A1* | 1/2016 | Matthews | B65D 73/0064 220/4.22 |
| 2016/0053917 | A1* | 2/2016 | Kean | F16L 3/223 248/58 |
| 2016/0214253 | A1* | 7/2016 | Yanuszka | B23D 57/023 |
| 2018/0043567 | A1* | 2/2018 | Johansson | B27B 17/0008 |
| 2018/0087293 | A1* | 3/2018 | Strassburger | E05B 69/003 |
| 2018/0339423 | A1* | 11/2018 | Zeno | B25H 3/006 |
| 2019/0016007 | A1* | 1/2019 | Hancock | B27B 17/02 |
| 2019/0077006 | A1* | 3/2019 | Velderman | A47F 5/0838 |
| 2019/0299484 | A1* | 10/2019 | Plante | B27G 19/003 |
| 2020/0030959 | A1* | 1/2020 | Freymueller | B25F 5/006 |
| 2020/0164499 | A1* | 5/2020 | Zhou | B25H 3/006 |
| 2021/0093077 | A1* | 4/2021 | Nishimura | A45F 5/021 |
| 2021/0239263 | A1* | 8/2021 | Hendricks | F16M 13/022 |

FOREIGN PATENT DOCUMENTS

| | | | |
|---|---|---|---|
| CN | 208210866 U | * | 12/2018 |
| CN | 208210866 U | | 12/2018 |

OTHER PUBLICATIONS

"Stihl Scabbard Chainsaw Chain Guard," last accessed Nov. 8, 2019, Retrieved from: https://www.chelfordfarmsupplies.co.uk/stihl-scabbard-chainsaw-chain-guard, all enclosed pages cited.

ArboristSite.com Sponsors "Saw Storage II," Discussion in 'Chainsaw' started by blsnelling, Sep. 20, 2008. Retrieved from: https://www.arboristsite.com/community/threads/saw-storage-ii.76550/, all enclosed pages cited.

Fedorov, V., "Rack with goods. Building tool on store shelves of various manufacturers. Chainsaws, electric saws, brush cutte," p. 1, Chelyabinsk Region, Russia (Jun. 24, 2019), all enclosed pages cited.

National Fire Fighter Corp. "True North Chainsaw Bar Cover," last accessed Nov. 8, 2019, Retrieved from: http://www.nationalfirefighter.com/store/p/3015-True-North-Chainsaw-Bar-Cover.aspx, all enclosed pages cited.

* cited by examiner

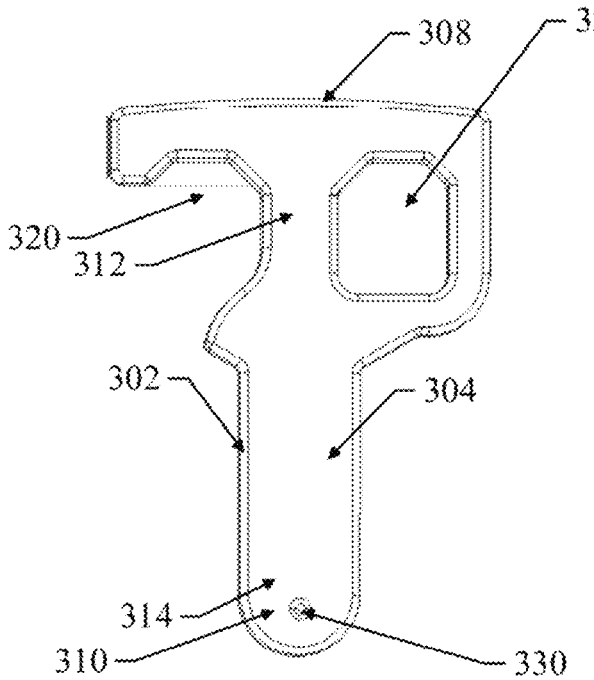
FIG. 6A
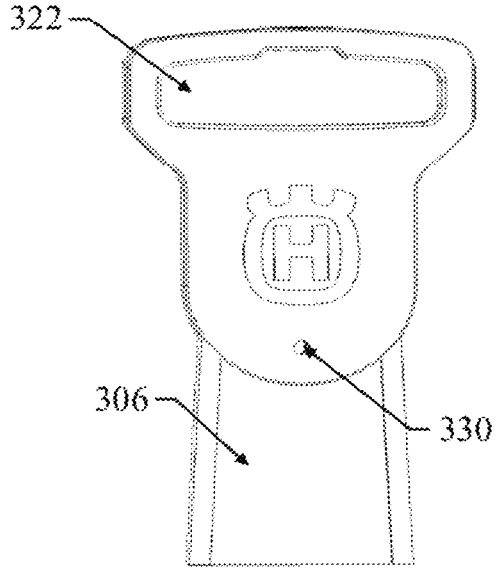
FIG. 6B
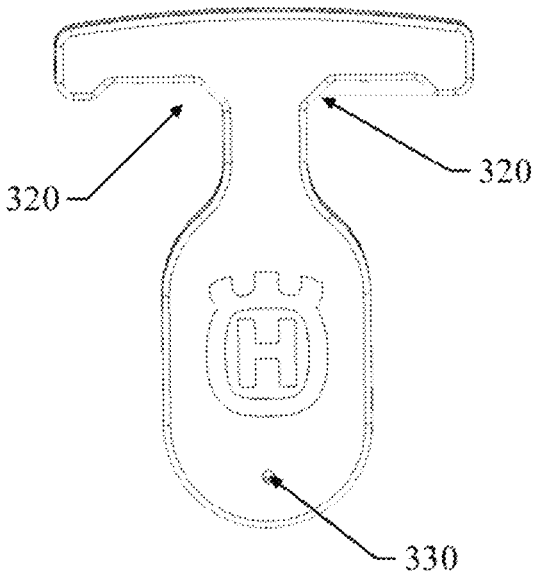
FIG. 6C
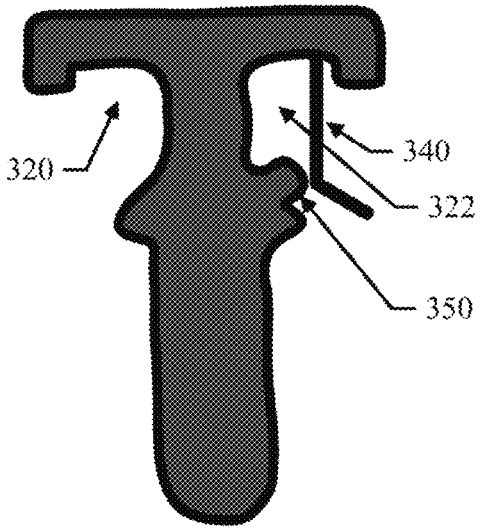
FIG. 6D
FIG. 6

DISPLAY OR STORAGE ASSEMBLY FOR HANDHELD POWER TOOL

TECHNICAL FIELD

Various example embodiments relate generally to a handheld power tool and in particular to an assembly for displaying or storing the handheld power tool.

BACKGROUND

In a retail or commercial store or setting, customers often wish to visually inspect merchandise when shopping. In this regard, merchandise in a retail store may be displayed from a peg, hook, or other display apparatus in a manner that is easily accessible by the user. When merchandise is displayed in this manner, a customer may easily grab, visually inspect, or compare the merchandise to other similar products during the shopping experience. To facilitate the customer engaging with and exploring the displayed merchandise, retailers often desire the merchandise to be packaged in a manner that allows for the merchandise to be easily displayed while also highlighting the notable features of the merchandise. With respect to handheld power tools, such as chainsaws, however, manufacturers and retailers often find it difficult to effectively display or store handheld power tools in a manner that lets a customer visually inspect, grab, or compare the tool to other similar products.

BRIEF SUMMARY OF SOME EXAMPLES

Example embodiments described herein provide a display or storage assembly for effectively displaying, storing, or hanging a handheld power tool. In this regard, a configuration of a handheld power tool, such as chainsaw, typically makes it very difficult to effectively display the tool in manner where the tool is easy to interact with and grab from a display apparatus. In this regard, the large housing and blade or working assembly of the handheld power tool normally prevents the tool from being displayed such that a consumer may interact with, grab, and visually inspect the tool. Example embodiments provided herein therefore provide a display or storage assembly that allows for the handheld power tool to be displayed, stored, or hung such that a user or customer may explore, touch, and easily grab the chainsaw while maintaining the safety of the user/customer. Furthermore, the assembly provided herein allows the handheld working tool to be displayed or stored so the tool utilizes less shelf space.

Accordingly, an example embodiment provided herein may provide for a hanger for suspending a chainsaw in a display. The display may include a bar assembly, and the bar assembly may include two parallel bars that are configured to project substantially parallel to each other and a ground plane. The hanger may include a body, and the body may have a first end, a second end, and an elongated plate-like member defining a first face and a second face. The hanger may also include a first interface portion disposed at the first end of the body, and the first interface portion may include a first aperture and a second aperture. The hanger may additionally include a second interface portion disposed at a portion of the body proximate to the second end, and a portion of the first face of the body may extend along a guide bar of the chainsaw from the second end toward the first end. The second interface portion may align with a receiving orifice formed in the guide bar to enable a releasable fastener to operably couple the guide bar to the hanger. The first and second apertures of the first interface portion may be configured to slidingly engage with the bars of the bar assembly to suspend the chainsaw from the bar assembly such that a longitudinal length of the guide bar extends substantially perpendicular to the ground plane.

A further example embodiment provided herein may provide for a storage or display assembly for a handheld power tool. The assembly may include a cover configured to receive a working assembly of the handheld power tool therein and surround a substantial portion of a longitudinal length of the working assembly of the handheld power tool. The assembly may also include a hanger operably coupled to the cover proximate to a distal end of the working assembly of the handheld power tool, the hanger being configured to hang or display the handheld power tool from a bar assembly such that a longitudinal length of the handheld power tool is oriented substantially perpendicular to a ground plane.

An even further example embodiment provided herein may provide for a method of displaying a chainsaw. The chainsaw may include a guide bar and a housing. The method may include attaching a cover to the guide bar and attaching a hanger to the cover. The method may additionally include suspending the chainsaw from a bar assembly via the hanger such that a longitudinal length of the guide bar extends substantially perpendicular to the ground plane.

BRIEF DESCRIPTION OF THE SEVERAL VIEWS OF THE DRAWING(S)

Reference will now be made to the accompanying drawings, which are not necessarily drawn to scale, and wherein.

Figure 7:
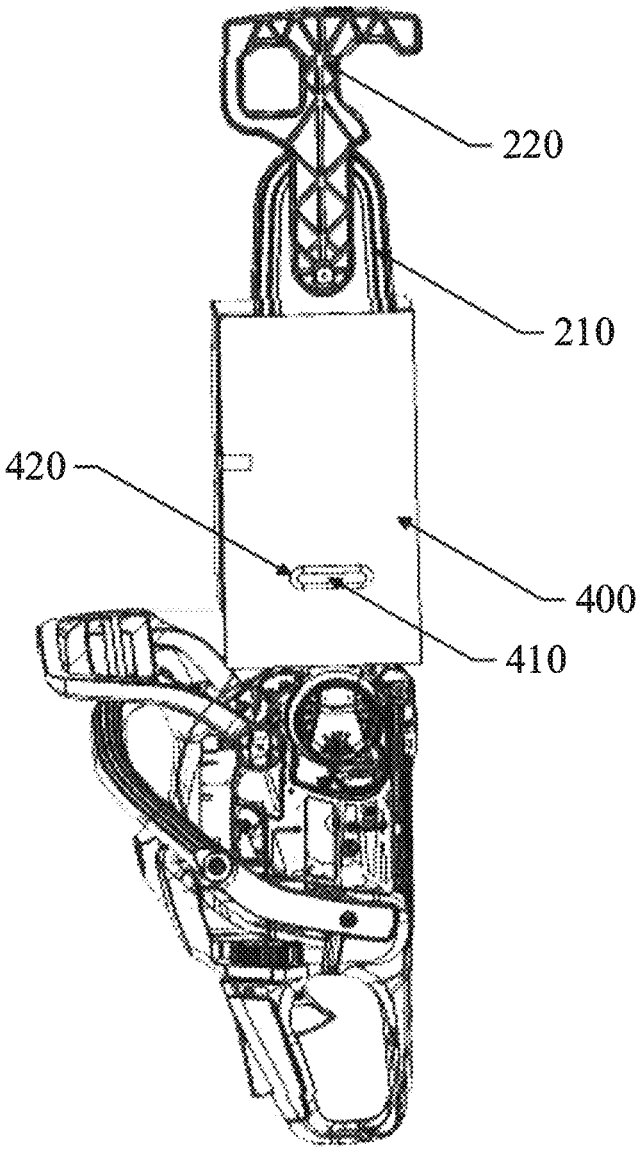
Figure 8:
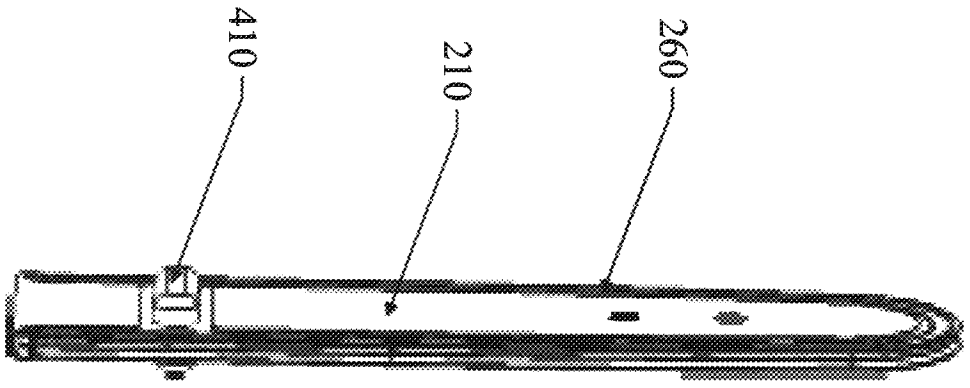
Figure 9:
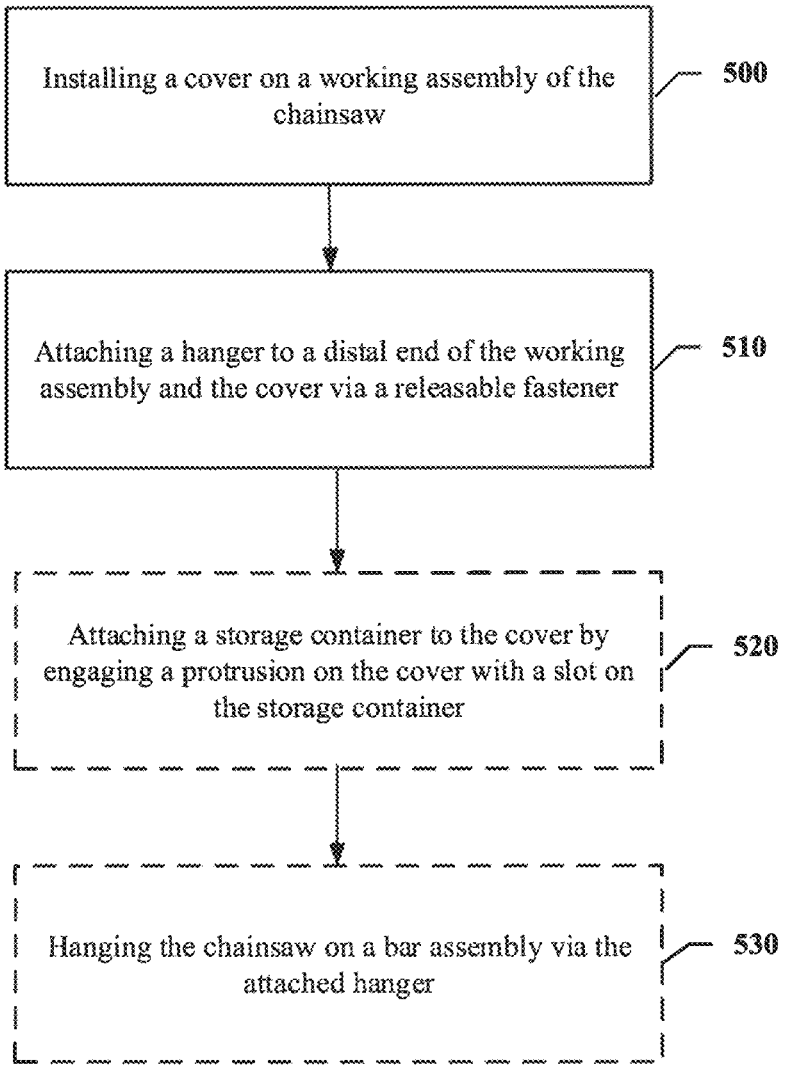

FIG. 6, which includes FIGS. 6A-6D, illustrates schematic views of a hanger according to example embodiments;

FIG. 7 illustrates a schematic view of a display or storage assembly disposed on a handheld power tool according to a further example embodiment;

FIG. 8 illustrates an isolated side view of a cover of the display or storage assembly according to a further example embodiment; and FIG. 9 illustrates a method of displaying or storing a handheld power tool according to an example embodiment.

DETAILED DESCRIPTION

Some example embodiments now will be described more fully hereinafter with reference to the accompanying drawings, in which some, but not all embodiments are shown. Indeed, the examples described and pictured herein should not be construed as being limiting as to the scope, applicability, or configuration of the present disclosure. Like reference numerals refer to like elements throughout. Furthermore, as used herein, the term "or" is to be interpreted as a logical operator that results in true whenever one or more of its operands are true. As used herein, "operable coupling" should be understood to relate to direct or indirect connection that, in either case, enables at least a functional interconnection of components that are operably coupled to each other.

As indicated above, a configuration of a handheld power tool, such as chainsaw, makes it very difficult to effectively display or store the tool in a manner that takes up less space while making sure the tool is easy to interact with and grab. In this regard, the components of the handheld power tool, such as the blade and the housing, have normally meant the handheld power tool is stored or hung from a handle of the housing thus making the handheld power tool dangerous to interact with because the tool is being picked up by the blade, or the handheld power tool is just placed on shelf taking up a significant amount of space. Accordingly, example embodiments provided herein provide a display or storage assembly that allows for the handheld power tool to be displayed, stored, or hung such that a user or customer may explore, touch, and easily grab the chainsaw by a handle while taking up less space and maintaining the safety of the user/customer.

Figure 1:
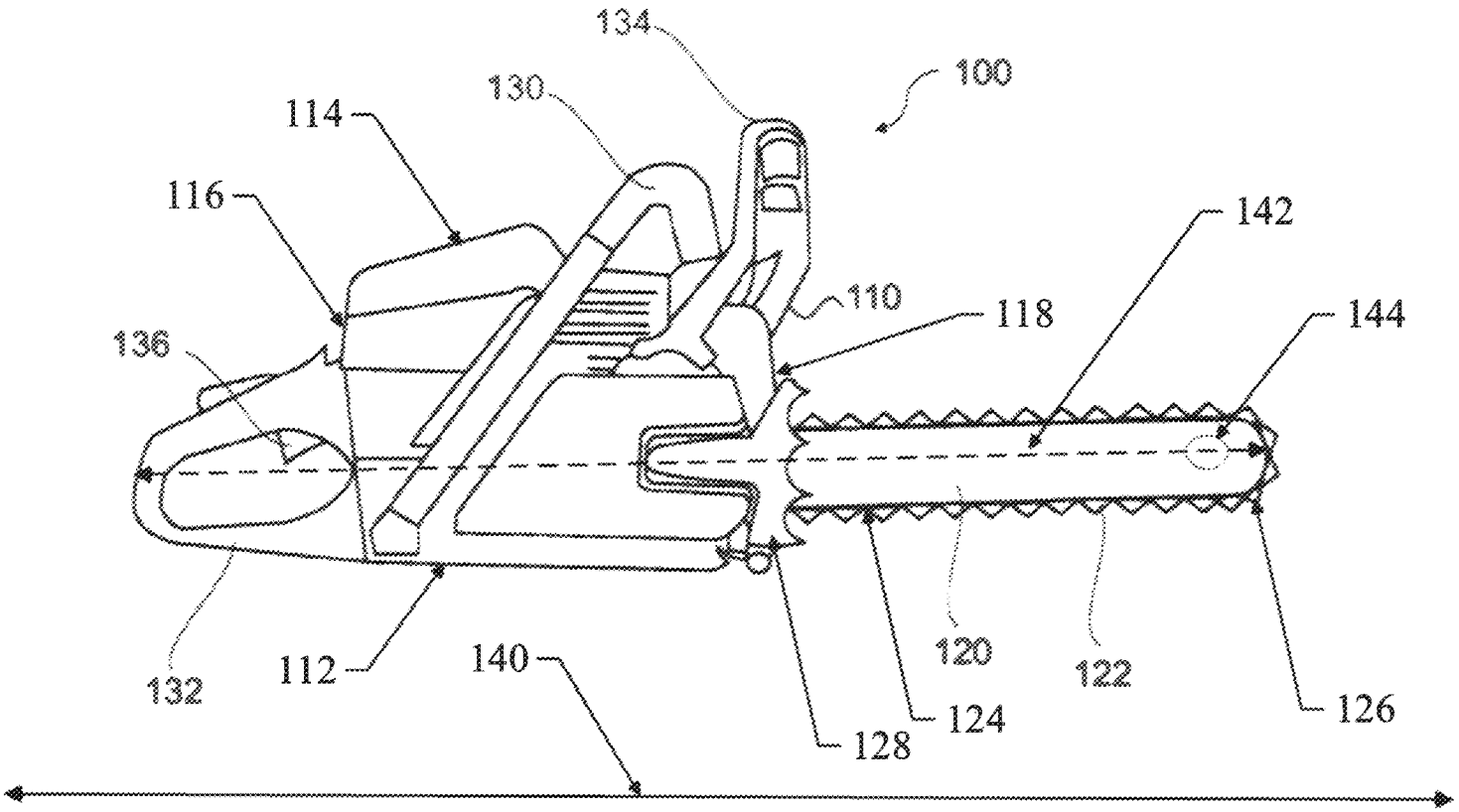
FIG. 1 illustrates a schematic view of a handheld power tool according to an example embodiment.

FIG. 1 illustrates an example embodiment of a handheld power tool to facilitate a description of some portion of the handheld power tool that are applicable to interaction with the display or storage assembly described herein. In this regard, FIG. 1 demonstrates a handheld power tool 100 in the form of a chainsaw. It should be appreciated that the chainsaw 100 may be merely one example of a handheld power tool that includes a working assembly. Thus, example embodiments could also be practiced in connection with other handheld power tools that may include working assemblies used for cutting a variety of materials such as wood, concrete, metal and the like. For example, the handheld power tool 100 could also be a power saw, a cut off saw, hedge trimmer, pole saw, or other suitable handheld power tools having a working assembly.

As shown in FIG. 1, the chainsaw 100 may include a housing 110. The housing 110 may include a base surface 112 and a top surface 114 opposite from the base surface 112. In this regard, the base surface 112 may be located closer to a ground plane or surface 140 when a longitudinal length 142 of the chainsaw 100 is substantially parallel to the ground plane or surface 140. In this regard, when the longitudinal length 142 of the chainsaw 100 may be substantially parallel to the ground plane 140, the chainsaw 100 may be understood to be in a "normal orientation." The housing 110 may also include a first side 116 and a second side 118 extending substantially perpendicular between the base surface 112 and the top surface 114, and the first side 116 may be opposite from and substantially parallel to second side 118 of the housing 110.

A power unit (not shown) may be arranged inside the housing 110, and the power unit may be either an electric motor or an internal combustion engine. The chainsaw 100 may further include a guide bar 120 having a first end 124 and a second end 126, and the guide bar 120 may be attached to the housing 110 along the second side 118 thereof. As shown in FIG. 1, a first end of 124 of the guide bar 120 may extend laterally from the second side 118 of the housing 110 substantially parallel to the base surface 112. Furthermore, it should be understood that the second end 126 of the guide bar 120 may be considered a front of the chainsaw 100 when the chainsaw 100 is in the "normal orientation" shown in FIG. 1, with the first side 116 of the housing 110 being considered a back of the chainsaw 100 when in the "normal orientation."

A chain 122 may be driven around the exterior perimeter of the guide bar 120 responsive to operation of the power unit in order to enable the chainsaw 100 to cut timber or other materials. The guide bar 120 and the chain 122 may together form the working assembly of the chainsaw 100. Furthermore, in accordance with example embodiments, the guide bar 120 may be a unitary, substantially flat metallic member that may be elongated to form a substantially oblong blade. However, in accordance with other example embodiments, the guide bar 120 may not necessarily be unitary, but may include component parts that are combined to form a flat blade.

As further shown in FIG. 1, the chainsaw 100 may also include a front handle 130 and a rear handle 132 relative to the front of the chainsaw 100 in the "normal orientation." A chain brake and front hand guard 134 may be positioned forward of the front handle 130 relative to the front of the chainsaw 100 to stop the movement of the chain 122 in the event of a kickback relative to the front of the chainsaw 100. The chainsaw 100 may also include a bumper spike 128 disposed on or proximate a second side of the housing 118 such that the bumper spike 128 projects outwardly therefrom toward the guide bar 120. The bumper spike 128 may be configured to rest upon the object being cut by the chainsaw 100 in order to aid in a cutting operation.

The rear handle 132 may include a trigger 136 configured to operate the power unit when the trigger 136 is actuated. In this regard, for example, when the trigger 136 is actuated (e.g., depressed), the rotating forces generated by the power unit may be coupled to the chain 122 either directly (e.g., for electric motors) or indirectly (e.g., for gasoline engines). The term "trigger," as used herein, should be understood to represent any actuator that is capable of being operated by a hand or finger of the user. Thus, the trigger 136 may represent a button, switch, or other such component that can be actuated by a hand or portion thereof that is configured to initiate movement of the chain 122 around the guide bar 120.

As noted above, displaying or storing a chainsaw 100 or other handheld power tools in a retail or commercial environment for purchase or demonstration has historically been difficult to accomplish in a configuration that allows for a consumer to interact with and compare to other chainsaws that are available for purchase or viewing. To overcome and address this difficulty, example embodiments herein may provide for a storage assembly 200 that allows for the effective display and storage of the chainsaw 100 from a bar assembly 230, peg, hook, or other display apparatus (see FIG. 5).

Figure 2:
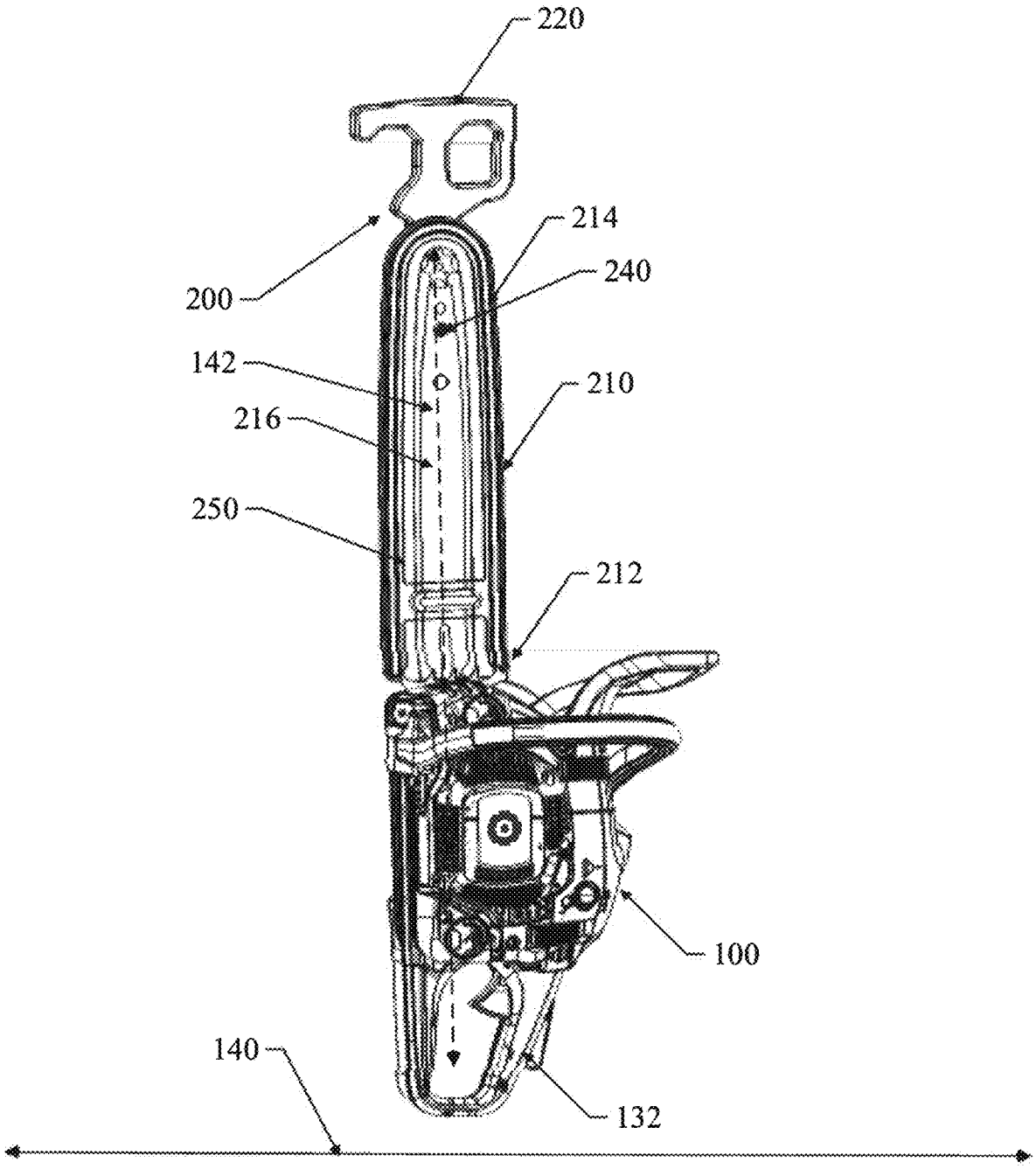
FIG. 2 illustrates a schematic view of a first side of a display or storage assembly disposed on a handheld power tool according to an example embodiment.
Figure 5:
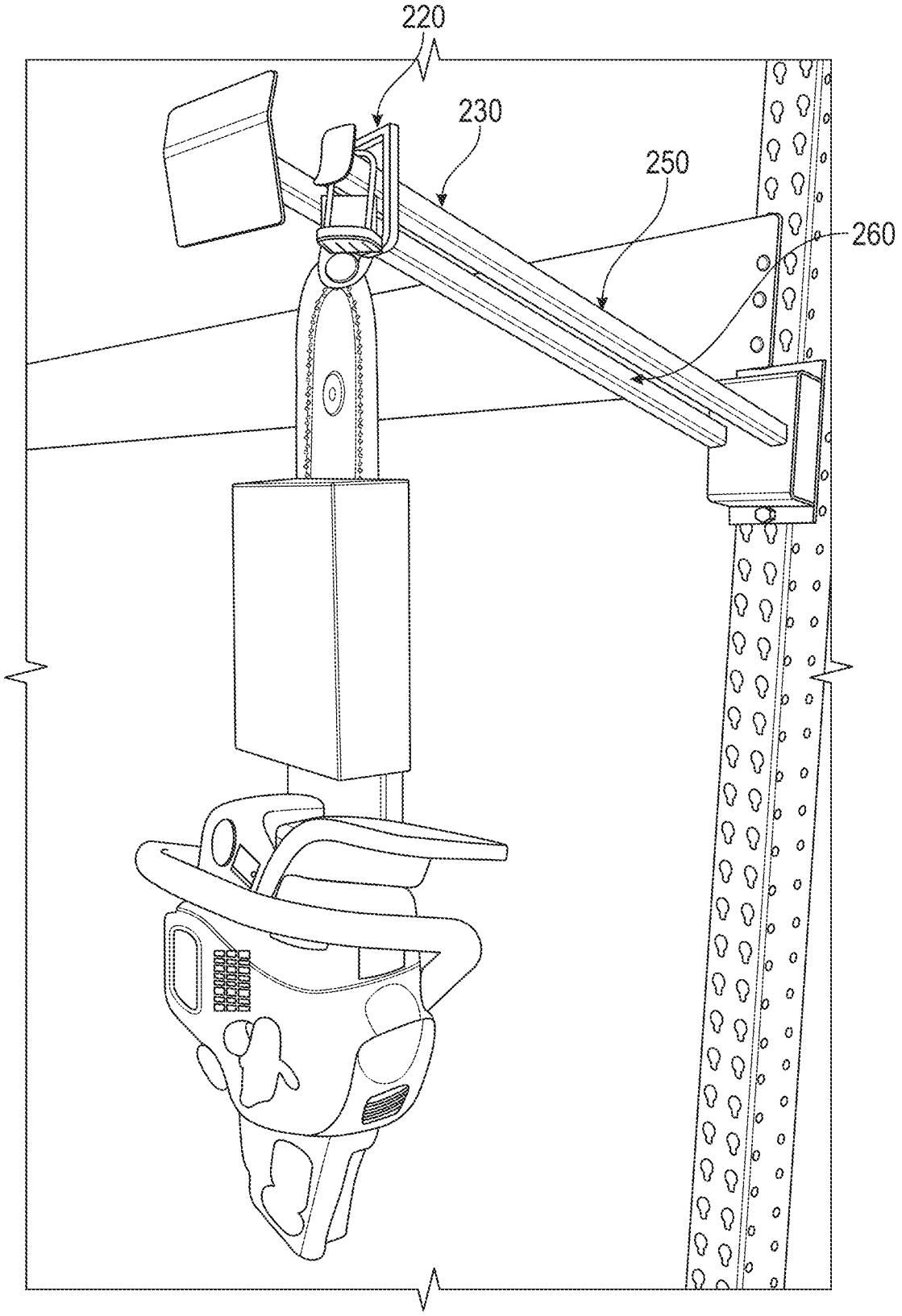
FIG. 5 illustrates a perspective view of a chain having a display or storage assembly disposed thereon and hung from a bar assembly according to an example embodiment.

FIG. 2 illustrates an example embodiment of a storage assembly 200 for displaying or storing the chainsaw 100 from the bar assembly 230 (see FIG. 5). As shown in FIG. 2, the storage assembly 200 may include a cover 210 and a hanger 220. The cover 210 may be configured to cover and be disposed around the working assembly (i.e., the guide bar 120 and the chain 122) of the chainsaw 100. In this regard, the cover 210 may be configured to slide over and be disposed around a substantial portion or an entirety of an exposed portion of the guide bar 120 and chain 122. In other words, the cover 210 may have a first side 250 and a second side 260 (see FIG. 3) with a cavity 216 defined therein, and the cavity 216 may be configured to receive the working assembly such that the cover 210 slides over and covers the working assembly. In this regard, the cover 210 may be a sheath or scabbard to protect the working assembly located therein. Thus, the cover 210 safeguards not only the working assembly while the chainsaw 100 is displayed or stored but also protects the user or consumer from being exposed to the chain 122 when the chainsaw 100 is on display.

Figure 4:
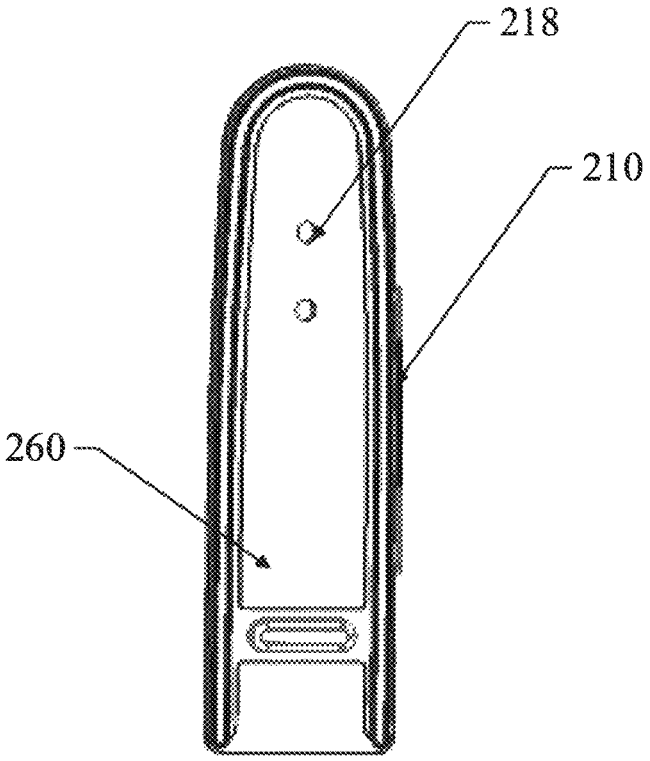
FIG. 4 illustrates an isolated view of a cover of the display or storage assembly according to an example embodiment.

As shown in FIG. 2, the cover 210 may include a proximal end 212 and a distal end 214 and defines the cavity 216 for receiving the working assembly of the chainsaw 100. The proximal end 212 may have an opening configured to receive the second end 126 of the working assembly in order to slide over and cover the working assembly. In this regard, the cavity 216 of the cover 210 slides over and up the working assembly toward the second side 118 of the housing 110 until the proximal end 212 is substantially flush with or proximate to the second side 118 of the housing 110 of the chainsaw 100. When the cover 210 is substantially flush with or proximate to the second side 118 of the housing 110, a receiving orifice 218 (see FIG. 4) disposed in the cover 210 may be substantially aligned with a receiving orifice 144 disposed in the working assembly (see FIG. 1). Each of the receiving orifices 144, 218 may be configured to receive a releasable fastener 240 further described herein. Accordingly, the cover 210 may have a predefined longitudinal length that allows the cover 210 to extend substantially from the second end 126 to the first end 124 of the working assembly. Additionally, the cover 210 may be a unitary body that forms a sheath or scabbard that may be slid over the working assembly with a relatively tight tolerance. In this regard, the cover 210 may have a predefined width to accommodate the width of the working assembly of the chainsaw 100.

In some cases, the cover 210 may be formed of a transparent material in order to allow the user or the consumer to see the working assembly through the cover 210. In this regard, the material forming the cover 210 may be a thermoplastic material such as polyvinyl chloride (PVC), polypropylene, polyethylene, nylon, various styrenes, or copolymers or blends thereof. It should be also understood that other polymer resins may also be used to form the cover 210.

As further shown in FIG. 2, the storage assembly 200 may also include a hanger 220. In this regard, the hanger 220 may be operably coupled proximate or to the distal end 214 of the cover 210 to allow the chainsaw 100 to be hung from or stored on the bar assembly 230 or other similar display apparatuses. In this regard, the hanger 220 allows the chainsaw 100 to hang from the bar assembly 230 in an orientation where the longitudinal length 142 of the chainsaw 100 is perpendicular to the ground plane 140. In this regard, the rear handle 132 is proximate and closer to the ground plane 140 than other components of the chainsaw 100 such as the working assembly. When the chainsaw 100 is hung or stored in this orientation, particularly in a retail or commercial setting, the handles 130, 132 may be located near or proximate to a waist of the user/consumer thus allowing a consumer or user to easily access or grab the chainsaw 100 at the handles 130, 132 of the chainsaw 100. This may be a more favorable orientation for the consumer or the user as it provides a safer position for the consumer/user to grab the chainsaw 100 thus generally making the consumer/user more comfortable to grab and interact with the chainsaw 100. Furthermore, the housing 110 of the chainsaw 100 may be easily viewable and accessed by the user/consumer so the user/consumer can view the entirety of the chainsaw 100 and then easily pick up and grab the chainsaw 100.

Figure 3:
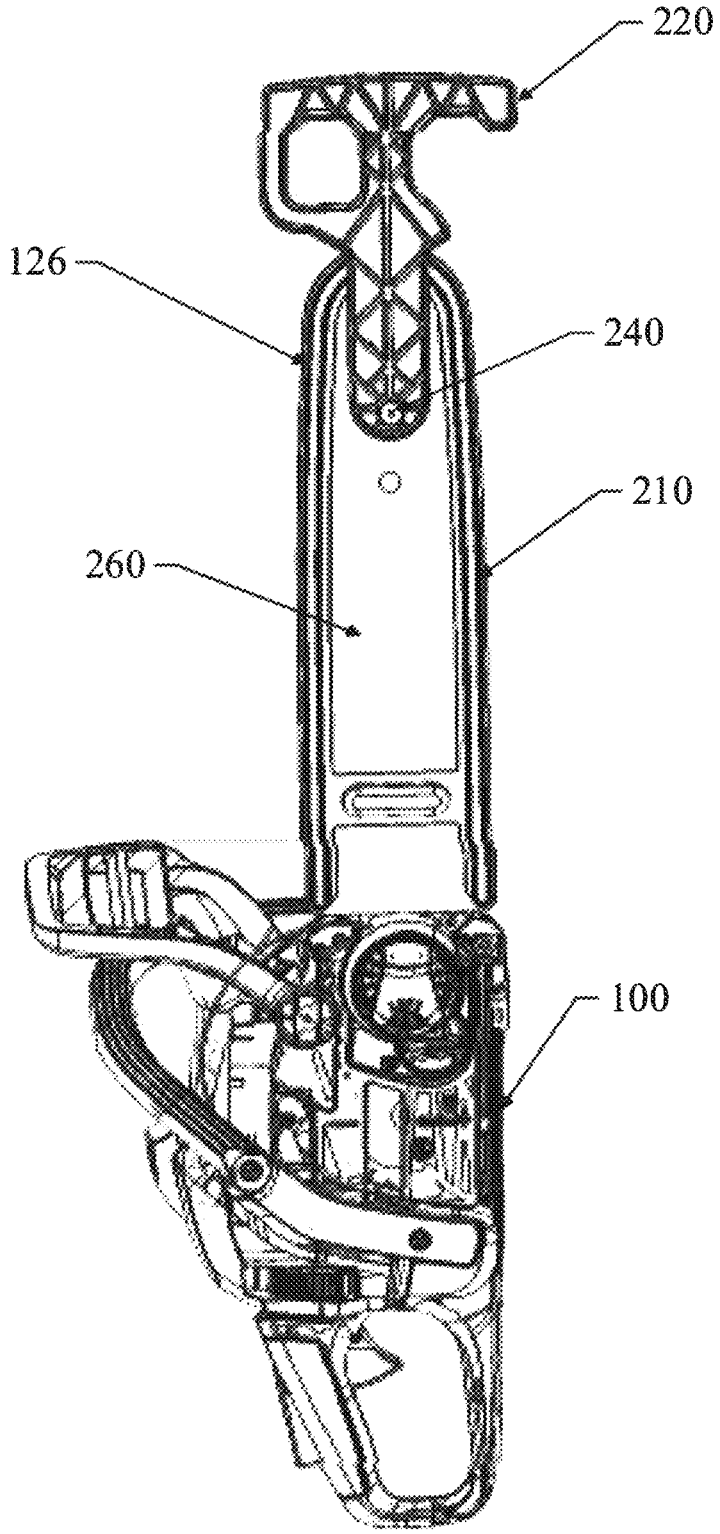
FIG. 3 illustrates a schematic view of a second side of a display or storage assembly disposed on a handheld power tool according to an example embodiment.

As noted above, the hanger 220 may be attached proximate to or at the distal end 126 of the working assembly of the chainsaw 100. In this regard, the hanger 220 may be attached to either of the first side 250 or the second side 260 (see FIG. 3) of the cover 210 via a releasable fastener 240. FIG. 3 illustrates an example embodiment of the assembly 200 with the hanger 220 attached to the second side 260 of the cover 210 via the releasable fastener 240. In this regard, each of the working assembly, the cover 210, and the hanger 220 may include a receiving orifice 144 (see FIG. 1), 218 (see FIG. 4), 330 (see FIG. 6) disposed therein to receive the releasable fastener 240. When the cover 210 is disposed on the working assembly, each of the receiving orifices 144, 218 of the working assembly and cover 210 may align as noted above. When operably coupling the hanger 220 to the cover 210, the receiving orifice 330 of the hanger may then be aligned with the receiving orifices 144, 218 of the cover 210 and the working assembly such that the releasable fastener 240 may pass through each of the receiving orifices 144, 218, 330 located in the working assembly, the cover 210, and the hanger 220 in order to secure the hanger 220 to the cover 210 and the working assembly. Because the releasable fastener 240 passes through each of the working assembly and the cover 210, the releasable fastener 240 may also prevent removal of the cover 210 from the working assembly until the releasable fastener 240 is removed or unfastened from the cover 210. The releasable fastener 240 may be a screw, nut/bolt assembly, or any other assembly or fastener known the art that is configured to releasably secure the hanger 220 to the cover 210. It should be understood that other example embodiments provided herein may provide for a hanger 220 that is integrally formed with, glued, or other affixed to the cover 210, and the releasable fastener 240 may not be needed or may be used only to more effectively secure the cover 210 to the working assembly.

The configuration or design of the hanger 220 may be based on the type of bar assembly 230 or display apparatus that the chainsaw 100 will be hung from or on whether the hanger 220 may be locked to the bar assembly 230 or display apparatus. FIG. 6, which includes FIGS. 6A-6D, illustrates example embodiments of various configurations of the hanger 220. The hanger 220 may include a body 302. The body may be an elongated plate-like member that defines a first face 304 and a second face 306 opposite from the first face 304. Furthermore, the body 302 may have a first end 308 and a second end 310. In some cases, the second end 310 of either or both of the first face 304 and the second face 306 of the hanger 220 may be configured to extend toward or be aligned with the guide bar of the chainsaw 100. In this regard, the second end 310 of the hanger 220 may extend from a distal end 214 of the guide bar toward a proximal end 212 of the guide bar when the hanger 220 is operably coupled to the cover 210.

Additionally, the hanger 220 may include a first interface portion 312 disposed proximate or at the first end 308 of the body 302, and a second interface portion 314 disposed proximate or at second end 310 of the body 302. The first interface portion may include at least one aperture 320, 322. In this regard, a user, retailer, or manufacturer may desire to hang the chainsaw 100 from a bar assembly 230 or other similar display apparatus to support the weight of the chainsaw 100. As shown in FIG. 5, the bar assembly 230 may include two bars 250, 260 that may each extend perpendicular away from a wall or surface. The bars 250, 260 may be parallel to each other and to the ground plane 140. However, it should be understood that in accordance with other example embodiments, the bar assembly 230 may include only one bar, peg, hook, or other display apparatus or device. Accordingly, the hanger 220 may have at least one aperture 320, 322 configured to receive a bar 250, 260 of the bar assembly 230. In this regard, a hanger may have two apertures 320, 322 configured to receive a respective bar 350, 360 of the bar assembly 230. However, in other cases, the hanger 220 may include only a single aperture 320, 322 to support one or more bars 250,260

Each of the apertures 320, 322 may be an open 320 or closed aperture 322. In this regard, a closed aperture 322 may be surrounded on all sides by a portion of the body 302 of the hanger 220 (see FIG. 6B). However, an open aperture 320 may have at least one side that is not surrounded by a portion of the body 302 of the hanger 220 (see FIG. 6C). In this regard, when the aperture is an open aperture 320, the aperture 320 may be open on a side or periphery of the body 302 of the hanger 230.

As shown in FIG. 6A, the hanger 220 may include both an open aperture 320 and a closed aperture 322. In this regard, when it desired to lock the hanger 220 to the bar assembly 230 or other display apparatus, at least one of the apertures 320, 322 on the hanger 220 may be a closed aperture 322. As shown in FIG. 6C, both apertures 320 may be open apertures 320 thereby forming a T-shaped hanger 220 because the hanger 220 may not be intended to be locked to the bar assembly 230. Accordingly, based on the type of the bar assembly 230, bar, or other type of display device, the chainsaw 100 may be hung or displayed from, the hanger 220 may have one or more apertures 320, 322, and the apertures 320, 322 may be closed 322 or open 320 based on whether the hanger 220 will be locked to the bar assembly 230 for security deterrence.

As shown in FIG. 6D, the hanger 220 may be a self-closing or self-locking hanger 220. In this regard, the closed aperture 322 may include a pivotable or movable arm 340 (see FIG. 6D). In this regard, the arm 340 may swing open either into or away from the aperture 322. For example, when the hanger 220 is self-closing, the arm 340 may swing into the aperture 332 in response to the bar assembly 230 exerting a force on the arm 340. Thus, when a bar 250, 260 of the bar assembly 230 is received into the aperture 322, the arm 340 may automatically swing close to effectively and securely hang the hanger 220 on to the bar 250, 260.

When the hanger 220 is self-locking, the hanger 220 may be configured to be secured or locked when the arm 340 is engaged with a lock 350 disposed on the hanger 220. In this regard, the hanger 220 may be configured to be locked to the bar 350, 360 of the bar assembly 230 when the arm 340 is engaged with the lock 350 and may only be removed from the bar assembly 230 when the lock 350 is disengaged via cutting, using a tool, or some other similar method. In some cases, the lock 350 may be an orifice configured to receive a separate locking device or zip tie therein to effectively secure the arm 340 to the lock 350.

As noted above, the hanger 220 may also include a second interface portion 314 disposed proximate or at second end 310 of the body 302. The receiving orifice 330 of the hanger 220 may be disposed on the second interface portion 314, and the receiving orifice 330 may be configured to receive the releasable fastener 240 as described above. In this regard, when the receiving orifice 330 disposed on the second interface portion 314 aligns with the receiving orifices 144, 218 formed in the cover 210 and/or the working assembly, the releasable fastener 240 may be received into the receiving orifices 144, 218, 330 thereby operably coupling the cover 210 to the hanger 220. By having the apertures 320, 322 disposed proximate the first end 308 and the receiving orifice 330 disposed proximate a second end 310, the hanger 220 may be threaded on the bar assembly 230 while allowing space for the chainsaw 100 to effectively hang from the hanger 220 and the bar assembly 230. Furthermore, the hanger 220 may be formed of a rigid material such as steel, aluminum, plastic, pulp, or cardboard. However, in accordance with other example embodiments, the hanger 220 may be formed of a flexible material such as polypropylene.

In further example embodiments, the storage assembly 200 may further include a storage container 400 in addition to the cover 210 and the hanger 220. FIG. 7 illustrates an example embodiment of the assembly 200 including a storage container 400 in addition to the cover 210 and the hanger 220 described above. As shown in FIG. 7, the storage container 400 may be operably coupled to the cover 210 and configured to hold any packaging material, manuals, or other accessories relevant to the chainsaw 100. In some cases, the storage container 400 may be a unitary piece of material such as cardboard that is configured to be folded around the first side 250 and the second side 260 of the cover 210 to effectively hold the packaging material, manuals, or accessories relevant to the chainsaw 100. In some cases, the storage container 400 may be configured to cover the bumper spike 128 to further enhance the safety of the user/consumer. In this regard, the storage container 400 is configured to extend away from the second side 118 of the housing 110 partially down the longitudinal length of the working assembly.

When the storage assembly 200 includes a storage container 400, the cover 210 may also include an engagement protrusion 410 (see also FIG. 8). In some cases, as shown in FIG. 7, the engagement protrusion 410 may be disposed proximate to the proximal end 124 of the working assembly when the cover 210 is attached to the working assembly. The engagement protrusion 410 of the cover 210 may be configured to engage a slot 420 on the storage container 400 in order to operably couple the storage container 400 to the cover 210.

The engagement protrusion 410 may be an extension of or protrusion on the cover 210 that extends perpendicular from either a surface of the first side 250 or the second side 260 of the cover 210 (see FIG. 8). The engagement protrusion 410 may be configured to be received by and extend through the slot 420 to hold the storage container 400 in place relative to cover 210 and the working assembly.

In some cases, the storage assembly 200 may also include a security device [not shown] that may be affixed to either of the cover 210 or hanger 220 of the storage assembly 200. The security device may be used to ensure that the chainsaw 100 is not removed from the retail or commercial setting without proper point of sale processing. In this regard, the chainsaw 100 may be displayed as described herein, and thus in order to protect the chainsaw 100, the security device may be operably coupled thereto. Therefore, if the customer/user tried to steal the displayed chainsaw 100 without removing the security device first, the security device may cause alarming functions.

Example embodiments provided herein may also extend to a method of packaging the chainsaw 100 for display or storage with the assembly 200. FIG. 9 illustrates a method of assembling the assembly 200 and displaying the chainsaw 100 according to an example embodiment. As shown in FIG. 9, the method may include installing a cover, as described herein, on a working assembly of the chainsaw at operation 500. In this regard, the cover may be slid over the working assembly toward a second side of the housing of the chainsaw, as described above. The method may further include attaching a hanger to a distal end of the working assembly and the cover via securing a releasable fastener through aligned openings in each of the hanger, the cover, and the working assembly at operation 510. In some embodiments, the method may include an additional operation (which may be optional in some cases) of attaching a storage container to the cover by engaging a protrusion on the cover with a slot on the storage container at operation 520. The method may also include hanging the chainsaw on a bar assembly via the attached hanger such that the chainsaw is oriented perpendicular to a ground plane and a handle of the chainsaw is closer to the ground plane than the working assembly at operation 530.

Accordingly, example embodiments provide a storage or display assembly for a handheld power tool. The assembly may include a cover configured to receive a working assembly of the handheld power tool therein and surround a substantial portion of a longitudinal length of the working assembly of the handheld power tool. The assembly may also include a hanger operably coupled to the cover proximate to a distal end of the working assembly of the handheld power tool, the hanger being configured to hang or display the handheld power tool from a bar assembly such that a longitudinal length of the handheld power tool is oriented substantially perpendicular to a ground plane.

In some embodiments, the features described above may be augmented or modified, or additional features may be added. These augmentations, modifications and additions may be optional and may be provided in any combination. Thus, although some example modifications, augmentations and additions are listed below, it should be appreciated that any of the modifications, augmentations and additions could be implemented individually or in combination with one or more, or even all of the other modifications, augmentations and additions that are listed. As such, for example, the hanger may be further configured to hang or display the handheld power tool such that a housing of the handheld power tool is closer to the ground plane than the working assembly of the handheld power tool. Alternatively or additionally, a releasable fastener may be configured to extend though a receiving orifice disposed in each of the working assembly, the cover, and the hanger to operably couple the hanger to the cover. Alternatively or additionally, the hanger may include an aperture to receive a portion of the bar assembly in order to hang or display the handheld power tool. Alternatively or additionally, the cover may be configured to extend from the distal end of the working assembly to a proximal end of the working assembly, and the proximal end of the working assembly may be coupled to a side of a housing of the handheld power tool. Alternatively or additionally, the assembly may include a storage container, the storage container being configured to be operably coupled to the cover of the handheld power tool to house a manual or one or more accessories of the handheld power tool therein. Alternatively or additionally, the storage container may be configured to extend around a first side and a second side of the cover at a portion of the cover that is proximate to a housing of the handheld power tool and not extend around the first side or the second side of the cover at a portion of the cover that is proximate to the distal end of the working assembly. Alternatively or additionally, the cover may include a protrusion and the storage container may include a slot, and the slot of the storage container may be configured to receive the protrusion of the cover to operably couple the storage container to the cover. Alternatively or additionally, the protrusion of the cover may be disposed proximate to a proximal end of the working assembly, and the proximal end of the working assembly may be coupled to a side of a housing of the handheld power tool. Alternatively or additionally, the handheld power tool may be a chainsaw, and the working assembly may include a guide bar and chain of the chainsaw. Alternatively or additionally, the hanger may include a body having an elongated plate-like member defining a first face and a second face, and the body may have a first end and a second end; a first interface portion disposed at the first end of the body, the first interface portion including a first aperture and a second aperture; and a second interface portion disposed at a portion of the body proximate to the second end, and a portion of the first face of the body may extend along the guide bar of the chainsaw from the second end toward the first end, and the second interface portion may align with a receiving orifice formed in the guide bar to enable a releasable fastener to operably couple the guide bar to the hanger, and the first and second apertures of the first interface portion may be configured to slidingly engage with two parallel bars of the bar assembly to suspend the chainsaw from the bar assembly such that a longitudinal length of the guide bar extends substantially perpendicular to the ground plane. Alternatively or additionally, first and second apertures of a hanger may be open on a side thereof that faces away from the first end of the body. Alternatively or additionally, at least one of the first and second apertures may be entirely enclosed around a periphery thereof by the body. Alternatively or additionally, the first aperture may be open on a side thereof that faces away from the first end of the body, and the second aperture may be entirely enclosed around a periphery thereof by the body. Alternatively or additionally, the first aperture may be open on a side thereof that faces away from the first end of the body, and the second aperture may include a locking arm member configured to alternate between an open position and a closed position, and in the closed position, the second aperture may be entirely enclosed around a periphery thereof by the body and the locking member. Alternatively or additionally, the second interface portion may include a second receiving orifice that aligns with the receiving orifice of the guide bar, and the releasable fastener may be provided in the receiving orifice of the guide bar and the second receiving orifice of the second interface portion to operably couple the guide bar to the hanger.

Many modifications and other embodiments set forth herein will come to mind to one skilled in the art to which these embodiments pertain having the benefit of the teachings presented in the foregoing descriptions and the associated drawings. Therefore, it is to be understood that the embodiments covered are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements or functions, it should be appreciated that different combinations of elements or functions may be provided by alternative embodiments without departing from the scope of the appended claims. In this regard, for example, different combinations of elements or functions than those explicitly described above are also contemplated as may be set forth in some of the appended claims. In cases where advantages, benefits or solutions to problems are described herein, it should be appreciated that such advantages, benefits or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A display for suspending a chainsaw comprising a guide bar, the display comprising:

a hanger;

a bar assembly including two parallel bars that are configured to engage with the hanger to suspend the chainsaw from the two parallel bars above a ground plane;

a cover attached to the guide bar; and a releasable fastener installed through a receiving orifice disposed in each of the guide bar, the cover, and the hanger to operably couple the hanger to the cover and the guide bar via the releasable fastener;

wherein the hanger comprises:

a body comprising an elongated plate-like member defining a first face and a second face, the body having a first end and a second end;

a first interface portion disposed at the first end of the body, the first interface portion comprising a first aperture and a second aperture; and a second interface portion disposed at a portion of the body proximate to the second end;

wherein a portion of the first face of the body extends along the guide bar of the chainsaw;

wherein the second interface portion comprises the receiving orifice in the hanger that aligns with the receiving orifice in the guide bar and the receiving orifice in the cover to operably couple the hanger to the cover and the guide bar via the releasable fastener;

wherein a midpoint is defined on the body between the first aperture and the second aperture, the midpoint being positioned at a point where distances between the midpoint and the first and second apertures are minimum, wherein a plane is defined that intersects the first aperture, the second aperture, and the receiving orifice of the hanger;

wherein a width across the body in the plane at the interface orifice is larger for engagement with the releasable fastener than a width across the body in the plane at the midpoint between the first aperture and the second aperture;

wherein the first and second apertures of the first interface portion are configured to slidingly engage with the bars of the bar assembly to suspend the chainsaw from the bar assembly such that a longitudinal length of the guide bar extends substantially perpendicular to the ground plane.

2. The display of claim 1, wherein the first and second apertures are open on a side thereof that faces away from the first end of the body.

3. The display of claim 1, wherein at least one of the first and second apertures is entirely enclosed around a periphery thereof by the body.

4. The display of claim 1, wherein the first aperture is open on a side thereof that faces away from the first end of the body, and wherein the second aperture is entirely enclosed around a periphery thereof by the body.

5. The display of claim 1, wherein the first aperture is open on a side thereof that faces away from the first end of the body, wherein the second aperture comprises a locking arm member configured to alternate between an open position and a closed position, and wherein in the closed position the second aperture is entirely enclosed around a periphery thereof by the body and the locking arm member.

6. A storage or display assembly for a handheld power tool, the assembly comprising:

a cover configured to receive a working assembly of the handheld power tool therein and surround a substantial portion of a longitudinal length of the working assembly of the handheld power tool;

a hanger operably coupled to the cover proximate to a distal end of the working assembly of the handheld power tool, the hanger being configured to hang or display the handheld power tool from a bar assembly such that a longitudinal length of the handheld power tool is oriented substantially perpendicular to a ground plane;

a releasable fastener configured to extend though a receiving orifice disposed in each of the working assembly, the cover, and the hanger to operably couple the hanger to the cover and the working assembly via the releasable fastener; and a storage container, the storage container being configured to be operably coupled to the cover of the handheld power tool to house a manual or one or more accessories of the handheld power tool therein, wherein the storage container is configured to extend around a first side and a second side of the cover at a portion of the cover that is proximate to a housing of the handheld power tool and not extend around the first side or the second side of the cover at a portion of the cover that is proximate to the distal end of the working assembly.

7. The storage or display assembly of claim 6, wherein the hanger is further configured to hang or display the handheld power tool such that a housing of the handheld power tool is closer to the ground plane than the working assembly of the handheld power tool.

8. The storage or display assembly of claim 6, wherein the hanger comprises an aperture to receive a portion of the bar assembly in order to hang or display the handheld power tool.

9. The storage or display assembly of claim 6, wherein the cover is configured to extend from the distal end of the working assembly to a proximal end of the working assembly, the proximal end of the working assembly being coupled to a side of a housing of the handheld power tool.

10. The storage or display assembly of claim 6, wherein the cover comprises a protrusion and the storage container comprises a slot, wherein the slot of the storage container is configured to receive the protrusion of the cover to operably couple the storage container to the cover.

11. The storage or display assembly of claim 10, wherein the protrusion of the cover is disposed proximate to a proximal end of the working assembly, the proximal end of the working assembly being coupled to a side of a housing of the handheld power tool.

12. The storage or display assembly of claim 6, wherein the handheld power tool is a chainsaw, and the working assembly comprises a guide bar and chain of the chainsaw.

13. The storage or display assembly of claim 12, wherein the hanger comprises:

a body comprising an elongated plate-like member defining a first face and a second face, the body having a first end and a second end;

a first interface portion disposed at the first end of the body, the first interface portion comprising a first aperture and a second aperture; and a second interface portion disposed at a portion of the body proximate to the second end, wherein a portion of the first face of the body extends along the guide bar of the chainsaw, wherein the first and second apertures of the first interface portion are configured to slidingly engage with two parallel bars of the bar assembly to suspend the chainsaw from the bar assembly such that a longitudinal length of the guide bar extends substantially perpendicular to the ground plane.

14. The storage or display assembly of claim 13, wherein the first aperture is open on a side thereof that faces away from the first end of the body, and wherein the second aperture is entirely enclosed around a periphery thereof by the body.

15. The storage or display assembly of claim 14, wherein a locking device is configured to interface with one of the parallel bars corresponding to the second aperture such that the hanger cannot be removed from the one of the parallel bars unless the locking device is removed.

16. A method of displaying a chainsaw comprising a guide bar and a housing, the method comprising:

attaching a cover to the guide bar, attaching a hanger to the cover, wherein attaching the hanger to the cover comprises installing a releasable fastener though a receiving orifice disposed in each of the guide bar, the cover, and the hanger to operably couple the hanger to the cover and the guide bar via the releasable fastener, and suspending the chainsaw from a bar assembly via the hanger such that a longitudinal length of the guide bar extends substantially perpendicular to the ground plane.

* * * * *